US006024896A

United States Patent [19]

Okutomi et al.

[11] Patent Number: 6,024,896

[45] Date of Patent: Feb. 15, 2000

[54] CONTACTS MATERIAL

[75] Inventors: Tsutomu Okutomi, Kanagawa-ken; Atsushi Yamamoto; Tsuneyo Seki, both of Tokyo; Tadaaki Sekiguchi, Kanagawa-ken, all of Japan

[73] Assignee: Kabushiki Kaisha Toshiba, Kawasaki, Japan

[21] Appl. No.: 09/037,032

[22] Filed: Mar. 9, 1998

[30] Foreign Application Priority Data

Mar. 7, 1997 [JP] Japan ..... 9-052901

[51] Int. Cl.[7] ..... H01B 1/02; H01B 1/04

[52] U.S. Cl. ..... 252/516; 252/514; 252/515; 252/504; 420/497; 420/431; 419/18

[58] Field of Search ..... 74/240, 242, 247; 420/497, 247, 431; 428/551; 419/18; 252/504, 509, 511, 515, 516, 514

[56] References Cited

U.S. PATENT DOCUMENTS 3,683,138 8/1972 Nabae et al. ..... 200/144 B

*Primary Examiner*—Yogendra Gupta
*Assistant Examiner*—D G Hamlin
*Attorney, Agent, or Firm*—Oblon, Spivak, McClelland, Maier & Neustadt, P.C.

[57] ABSTRACT

The contacts material of the present invention is contacts material including silver-tungsten carbide alloy containing 55–70 weight % of tungsten carbide (WC) of mean particle size 0.1–6 μm wherein is included 0.005–0.2 weight % of carbon in an undissolved state or non-compound state whose equivalent diameter is 0.01–5 μm.

The present invention enables the current interruption characteristics of contacts material to be improved.

12 Claims, 1 Drawing Sheet

CONTACTS MATERIAL

BACKGROUND OF THE INVENTION

1. Field of the Invention

The present invention relates to contacts material for the make-and-break electrodes in vacuum circuit breakers, etc., that require outstanding current chopping and voltage-withstand characteristics.

2. Description of the Related Art

Existing vacuum valve contacts are constituted from various materials in order to support and improve the current chopping characteristic, anti-arc erosion resistance characteristic, contact resistance characteristic and temperature rise characteristic in addition to the three basic requirements represented by the anti-welding characteristic, voltage withstand characteristic, and current interrupting characteristic. However, it has been considered impossible to satisfy these requirements adequately with one element alone since mutually conflicting materials properties are often required. Contacts materials for specific applications such as high current breaking application, high withstand voltage application or low current-chopping application have therefore been developed by forming material composites or by cladding, etc., and as they stand, such materials exhibit outstanding characteristics.

Copper-bismuth (Cu—Bi) and copper-tellurium (Cu—Te) alloys containing not more than 5 weight % of an anti-welding component of bismuth (Bi) or tellurium (Te) as described in Japan Patent publication No.41-12131 (koukoku) and Japan Patent publication No.44-23751 (koukoku), for example, are known as contacts materials for high current breaking application that meet the aforesaid three basic requirements.

However, the reason why these have excellent high current interrupting characteristics is that the brittle bismuth precipitated at the particle boundary in copper-bismuth alloy and the brittle $Cu_2Te$ intergranular and transgranular precipitate in copper-tellurium alloy embrittle the alloy itself, realizing low-weld tripping capability. Likewise, copper-chromium(Cu—Cr) alloy is known as a high withstand voltage and high current breaking contacts material satisfying the three basic requirements. Since there is little vapor pressure difference between its constituents, copper-chromium alloy has the merit that it can be expected to exhibit uniform performance, and depending on how it is used, it is superior to copper-tellurium alloy.

At the same time, silver-tungsten carbide (Ag—WC) alloy (silver 40%) is known as a low chopping current contacts material, as described for example in Japan Patent Application No.42-68447. The alloy is widely used because it displays outstanding low chopping current performance by virtue of the synergistic effect between the thermionic emission of tungsten carbide (WC) and the moderate vapor pressure of silver (Ag).

Even higher performance could be secured from vacuum circuit breakers if further improvements were made in respect of the two problems noted hereunder. One is that, when current is interrupted using an inductive circuit under motor load, etc., without making proper allowance for the vacuum valve, a transient abnormal surge voltage can arise, adversely affecting the integrity of insulation of the load equipment.

The cause of the abnormal surge voltage is the current chopping that occurs at low current when current is interrupted in vacuum (when current interruption is performed forcibly without waiting for the natural zero point in the a.c. voltage waveform). The abnormal surge voltage Vs is proportional to the surge impedance Zo of the circuit and the chopping current Ic. Accordingly, as one means of holding down the abnormal surge voltage Vs, the chopping current Ic must be reduced, and silver-tungsten carbide alloy is utilized as a contacts alloy to secure advantages in this respect.

The other problem is that flashover may occur in the vacuum valve in vacuum circuit breakers after current interruption, giving rise to a phenomenon whereby through-conduction is re-established between the contacts (with non-continuation of discharge thereafter). The phenomenon is called restrike and although the mechanism thereof has not been elucidated, abnormal voltage is apt to develop owing to a sudden reversion to through-conduction once the electrical circuit has reached current interruption status.

According to experiments in which restrike is created by the breaking of a capacitor bank with a circuit breaker using silver-tungsten carbide alloy, the development of an extremely large overvoltage and an excessively large high frequency current is observed. The development of technology for suppressing restrike is therefore being pursued for silver-tungsten carbide alloy.

Although the mechanism responsible for restrike in silver-tungsten carbide alloy is still unknown, experimental observations by the inventors have indicated that restrike occurs with a fairly high frequency between contact and contact, and between contact and arc shield, in the vacuum valve. The inventors have therefore identified highly effective art for suppressing restrike, for example art for inhibiting the abrupt gas released when a contact receives an arc, art for optimizing contact surface form, etc., thereby contributing to the suppression of restrike.

Thus, the inventors made detailed observations on the correlation with restrike of the total amount of gas, the gas species and the form of emission of the gas released in heating silver-tungsten carbide alloy and discovered that the incidence of restrike rises at contacts for which a large amount of gas is released abruptly in pulses, albeit for an extremely short time, near the melting point.

The incidence of restrike was therefore reduced by excluding the factor of abrupt gas release beforehand, e.g. by heating the silver-tungsten carbide alloy above the melting point of silver (Ag), or by improving the sintering technology to suppress pore formation or structural segregation in the silver-tungsten carbide alloy. However, the need for further improvement is recognized in regard to recent requirements for greater suppression of restrike, and it is important to develop other approaches.

Thus, a prominent trend in recent years has been toward increasing severity of consumer operating conditions and diversification of load, with wider adaptation to reactor circuits and capacitor(condenser) circuits. Demand has grown for the provision of even lower chopping current and even lower restrike from low chopping current silver-tungsten carbide alloy, and the associated development and improvement of contacts materials have become a matter of urgency. In particular, because two to three times the normal voltage is applied, the surface of the contacts is greatly damaged by arcing during current breaking and current switching in condenser circuits; as a result, the contacts are vulnerable to surface roughening and ablation, which could contribute to restrike, and for this reason the contacts must be made more resistant to erosion. However, despite the importance of elucidating restrike from the perspective of improving product reliability, neither the technology to prevent restrike nor the direct causes thereof have yet been ascertained.

Although silver-tungsten carbide alloy has been deployed as a low chopping current type contacts material in preference to the aforementioned copper-bismuth alloy, copper-tellurium alloy or copper-chromium alloy, the fact remains that it cannot be considered a satisfactory contacts material given the growing need for lower restrike. Thus, even with the silver-tungsten carbide alloy hitherto preferentially used as low chopping current type contacts material, restrike is still observed in the more demanding high voltage region and in circuits associated with inrush current. It is therefore desirable to develop a contacts material that in particular has outstanding current chopping and anti-restrike characteristics in addition to supporting the aforementioned three basic requirements at an acceptable level.

SUMMARY OF THE PRESENT INVENTION

Accordingly, an object of the present invention is to provide a contacts material wherein the current chopping characteristic and anti-restrike characteristic can be improved by optimization of the metallurgical conditions obtaining in the silver-tungsten carbide alloy.

The aforesaid object of the present invention is attained by providing contacts material that has the following constitution, namely:

silver-tungsten carbide (Ag—WC) alloy containing 55–70% (weight %, likewise hereinafter) of tungsten carbide (WC) of mean particle size 0.1–6 μm, wherein carbon (C) in an undissolved state or non-compound-forming state in the size range 0.01–5 μm (diameter as equivalent sphere; likewise hereinafter) is present in an amount of 0.005–0.2%.

The aforesaid object of the present invention is additionally attained by providing contacts material that has the following constitution, namely:

silver-tungsten carbide-cobalt (Ag—WC—Co) alloy containing not more than 5% (including zero percent) of cobalt (Co) of mean particle size 0.1–5 μm and 55–70% of tungsten carbide (WC) of mean particle size 0.1–6 μm, wherein carbon (C) in an undissolved state or non-compound-forming state in the size range 0.01–5 μm is present in an amount of 0.005–0.2%.

The aforesaid object of the present invention is further additionally attained by providing contacts material that has the following constitution, namely:

silver-tungsten carbide (Ag—WC) alloy or silver-tungsten carbide-cobalt (Ag—WC—Co) alloy containing 0.01–0.5% of iron (Fe), wherein carbon (C) in an undissolved state or non-compound-forming state in the size range 0.01–5 μm is present in an amount of 0.005–0.2%.

The aforesaid object of the present invention is further additionally attained by providing contacts material that has the following constitution, namely:

silver-tungsten carbide (Ag—WC) alloy or silver-tungsten carbide-cobalt (Ag—WC—Co) alloy containing 0.05–0.5% of at least one of bismuth (Bi), antimony (Sb) and tellurium (Te), wherein carbon (C) in an undissolved state or non-compound-forming state in the size range 0.01–5 μm is present in an amount of 0.005–0.2%.

The aforesaid object of the present invention is further additionally attained by providing contacts material that has the following constitution, namely:

material wherein carbon (C) in an undissolved state or non-compound-forming state is highly dispersed in and distributed through a silver-tungsten carbide based alloy and the carbon particles are well separated by interstices larger than the carbon particles that are nearest neighbors.

The aforesaid object of the present invention is further additionally attained by providing contacts material that has the following constitution, namely:

material wherein the amount of silver (Ag) is increased from the surface of contact of the contacts material towards the interior (the direction perpendicular to the surface).

The aforesaid object of the present invention is further additionally attained by providing contacts material that has the following constitution, namely:

material wherein a copper (Cu) layer is provided on the other side of the surface of contact of the contacts material.

The aforesaid object of the present invention is further additionally attained by providing contacts material that has the following constitution, namely:

material wherein the thickness of the surface of the contact material is not less than 0.3 mm.

The aforesaid object of the present invention is further additionally attained by providing contacts material that has the following constitution, namely:

material wherein the average roughness (Rave) of the surface of contact of the contacts material is not more than 10 μm with a minimum roughness of not less than 0.05 μm.

The aforesaid object of the present invention is further additionally attained by providing contacts material that has the following constitution, namely:

material that has been surface-finished by current breaking at a current of 1–10 mA with a voltage of not less than 10 kV applied to the surface of contact of the contacts material.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
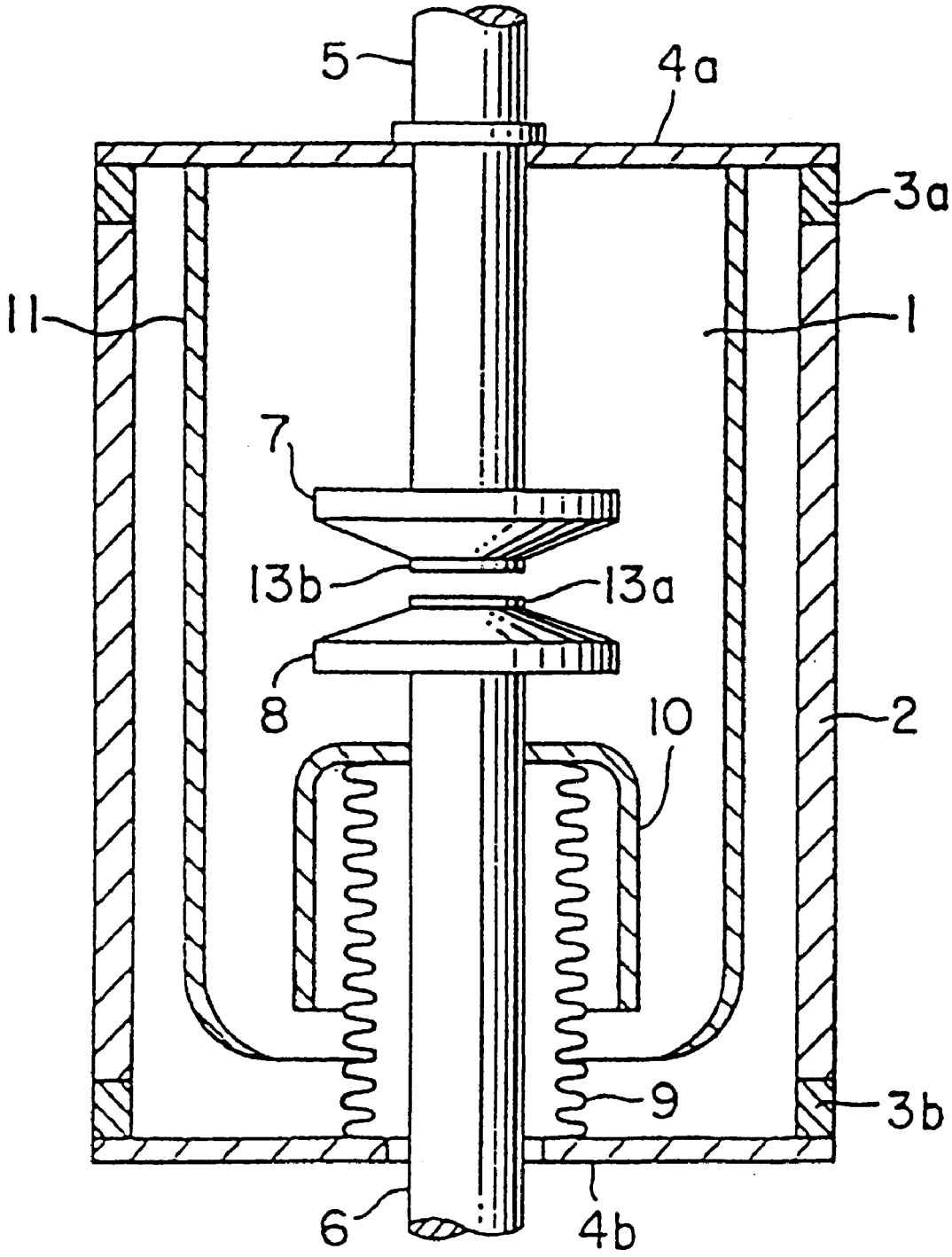
FIG. 1 is a cross-sectional view of a vacuum valve to which a contacts material for the vacuum valve according to this invention is applied.

Referring now to the drawings, wherein like reference numerals designate identical or corresponding parts throughout the several views, and more particularly to FIG. 1 thereof, one embodiment of the present invention will be described.

Embodiments of the present invention are described below with reference to the drawing. FIG. 1 is a cross-sectional view of a vacuum valve.

In FIG. 1, a circuit breaking chamber 1 is constituted by an insulating vessel 2 formed practically on a cylinder by insulating material and metal covers 4*a*,4*b* provided at both ends thereof, with the interposition of sealing fitments 3*a* and 3*b*, the chamber being maintained under vacuum.

The circuit breaking chamber 1 has arranged within it a pair of electrodes 7 and 8 mounted at facing ends of conductive rods 5 and 6. For example, the upper electrode 7 is the fixed electrode while the lower electrode 8 is the movable electrode. A bellows 9 is fitted to the conductive rod 6 of this electrode 8, so that movement in the axial direction of electrode 8 can be performed whilst maintaining vacuum-tightness within the circuit breaking chamber 1. A metal arc shield 10 is provided at the top of the bellows 9 to prevent the bellows 9 being covered by arc vapor. A metal arc shield 11 is provided in the circuit breaking chamber 1 so as to cover electrodes 7 and 8, to prevent the insulating vessel 2 being covered by arc vapor.

Silver-tungsten carbide alloy has been used for the contacts in the aforesaid constitution, exhibiting stable characteristics as a low chopping current contacts material. However, further improvement is needed in respect of the aforementioned need to improve both the current chopping characteristic and restrike characteristic. In the circuit breakers recently developed it is extremely important to make both characteristics lower while also maintaining the low values, and to ensure a small width of dispersion therein, particularly after the circuit breaker has operated a prescribed number of times.

When an external magnetic field (for example an axial magnetic field) is applied to the silver-tungsten carbide contacts 13*a* and 13*b* and a large current is interrupted, the arc created by breaking is prevented from persisting and concentrating in the parts of low arc voltage and the arc travels over the contact electrode surface. A low current chopping characteristic is thereby maintained, in addition whereto the effect contributes to a reduction in the incidence of restrike. Thus, since the arc travels easily over the contact electrode, arc diffusion is promoted, leading to a substantial increase in the contact electrode area that processes the breaking current, and as a result of arc persistence and concentration being reduced, other benefits accrue in that localized abnormal evaporation of the contact electrode is suppressed and surface roughening is reduced, contributing to restrike suppression.

However, when a current of more than a certain value is interrupted, the arc persists at one or a plurality of unpredictable points and causes abnormal fusion of the contact electrode surface, bringing the contacts to the interruption limit. Abnormal fusion also invites further deterioration in the interruption limit since the metal vapor evolved by instantaneous, explosive evaporation of the silver-tungsten carbide contact material greatly impairs insulation recovery of the vacuum circuit-breaker in contact opening.

Furthermore, abnormal fusion produces giant melt droplets, leading to roughening of the contact electrode surface and also to a decrease in withstand voltage characteristic, an increased incidence of restrike, and abnormal erosion of the material. Since, as hereinbefore noted, it is completely unpredictable where the arc responsible for these phenomena will persist on the contact electrode surface, it is desirable to present surface conditions at the contacts whereby the arc generated is not allowed to persist but can travel and diffuse.

To present the said desirable conditions, the present invention optimizes the amount of tungsten carbide (WC) and amount of carbon (C) in the silver-tungsten carbide alloy and optimizes the size of the carbon particles. Improved strength of cohesion between the tungsten carbide particles and carbon particles and structural homogeneity of the silver (Ag) and tungsten carbide (WC) in the contacts material, effective in restrike suppression, are consequently provided.

As a result, not only is the response controlled to reduce the amount of silver selectively and preferentially evaporated and dispersed on exposure of the contacts to an arc, but marked cracking on the contact surface due to thermal shock under arcing, an effect detrimental to suppression of restrike, is also prevented, and the shedding and dispersal of tungsten particles are reduced. In particular, a contacts material structure wherein the amount of carbon is optimized and the size of the carbon is limited to not more than 0.01–5 $\mu$m minimizes deterioration in the restrike characteristic while also contributing to improvement and stabilization of the current chopping characteristic.

Although the foregoing observations are mainly representative of silver-tungsten carbide alloy, the presence of carbon under the prescribed conditions affords the same trend in effect for silver-tungsten carbide-iron alloy or silver-tungsten carbide-cobalt alloy.

According to experiments, greater uniformity in alloy structure and an improvement in integration, etc., of the silver (Ag), tungsten carbide (WC) and carbon (C) were secured by optimization of the amount and size of the carbon in the silver-tungsten carbide, with the result that melting and dispersal damage to the contacts surface declined, affording the further benefit of improved resistance to arc erosion through reduced roughening of the contacts surface, which has a major effect on restrike suppression.

Furthermore, improvement in arc erosion resistance confers greater smoothness on the surface of the contacts and is beneficial in narrowing the width of dispersion (scatter) in the current chopping characteristic and restrike characteristic notwithstanding a large number of make and break cycles. In addition to the current chopping characteristic being maintained, a depressed restrike frequency and improvement in the arc erosion resistance of the silver-tungsten carbide alloy were provided by the synergistic effect thus obtained.

The carbon present in silver-tungsten carbide in the prescribed proportions is preferably in an undissolved state or non-compound-forming state. Unless the carbon is in such a state (an undissolved state or non-compound-forming state), the stability of the current chopping characteristic after a large number of make and break cycles, especially the width of dispersion in the characteristic, tends to increase. In addition, a large dispersion develops in the incidence of restrike after a large number of make and break cycles.

As hereinbefore noted, the mechanism of the restrike phenomenon is not yet known. According to experimental observations, however, restrike occurs with a fairly high frequency between contact and contact, and between contact and arc shield, in the vacuum valve. The inventors have therefore identified highly effective art for suppressing restrike, by pursuing for example inhibition of the abrupt gas released when a contact receives an arc, optimization of the surface form of the contacts, etc., and have thereby greatly reduced the incidence of restrike.

However, in respect of recent requirements for higher withstand voltages in vacuum valves, the breaking of higher currents, and miniaturization, the limit appears to have been reached for the aforesaid improvements to the contacts alone; and improvements and optimization additional to the aforesaid art are needed.

Furthermore, a detailed analysis of restrike by simulation experiments indicated that restrike involved situations where the contacts material contributed directly and situations where the design of the electrode structure, shield structure, etc., contributed, together with unforeseen electrical-mechanical external conditions such as high voltage exposure.

Simulated restrike experiments wherein various constituent parts such as the ceramic insulating vessel tube, the contacts, the arc shield, the metal covers, the conductive rods, the sealing metal, and the bellows were alternately fitted into and removed from the vacuum valve as appropriate, established that the composition, material and condition of the contacts directly receiving the arc, and the conditions in manufacture thereof, are important in relation to restrike. With particular reference to materials, silver-tungsten carbide of great hardness and high melting point was found to be more advantageous than copper-bismuth, copper-tellurium or copper-chromium alloys for which, because of their brittleness, much ejection and dispersal of microscopic metal particles into the electrode space was observed under impact during closing and breaking.

A more important observation was that, for the same silver-tungsten carbide alloy, a certain dispersion existed in ejection and dispersal of microscopic metal particles into the electrode space, and that in particular a high sintering temperature in the course of production of the silver-tungsten carbide alloy tended to favor suppression of restrike. This observation suggests both the need for improvement to the silver-tungsten carbide alloy and the possibility of restrike suppression.

It was therefore considered that the presence in the silver-tungsten carbide of an ancillary component of iron (Fe) meeting prescribed conditions would be beneficial in reducing ejection and dispersal of microscopic metal particles into the electrode space under impact during closure and breaking. Normally, the surface of the contacts develops numerous fine projections (surface irregularities) after closing and breaking, and although part of the surface is dispersed and shed, the presence of iron (Fe) in the silver-tungsten carbide of the present invention strengthened the bonding between silver (Ag) and tungsten carbide (WC) and improved ductility (elongation) within a very small area, and as a result thereof, had the effect of both reducing the incidence of fine surface irregularities as such and imparting a certain roundness to the tips of the fine surface irregularities. The field concentration coefficient $\beta$ of the surface of the contacts was therefore improved from more than 100 to less than 100.

It was thus suggested that the benefit of improvement in the field concentration coefficient $\beta$ due to the presence of carbon (C) and iron (Fe) in the silver-tungsten carbide overlies an improvement in the average roughness (Rave.) of the surface of the contacts.

Experiments wherein the restrike incidence was observed in vacuum valves made combining various sintering and infiltration conditions and mixed powder [Ag.WC] crushing (pulverizing)-dispersing-mixing conditions in the silver-tungsten carbide production process thus show that, for silver-tungsten carbide maintaining high hardness and high melting point properties, optimization of the mixing conditions, optimization of the alloy structure, and optimization of sintering technique are beneficial to suppression of restrike. Especially effective in optimization of the mixing conditions are the procedure for uniform mixing of the powder starting materials [silver (Ag) and tungsten carbide (WC)] and carbon (C) and the mixing procedure wherein the powder starting materials [silver (Ag) and tungsten carbide (WC)] are mixed with rocking vibration and stirring motion superimposed taught in the Production Examples 1–5 presented hereinafter.

Thus, the results of observations by the inventors on the relation between the time at which restrike occurs and the status of the silver-tungsten carbide materials suggest the importance of the production process, viz.:

(a) the results relating to the contact alloy structure and state thereof (segregation, uniformity) are characterized in that they correlate particularly with optimization of mixing conditions in the production process, random restrike occurring irrespective of the number of current interruption make and break operations;

(b) the results relating to the amount and status of the gas and moisture adhering to or adsorbed on the surface of the contacts are characterized in that restrike is seen from a comparatively early stage in repeated current interruption make and break operation and is bound up with the handling environment after processing of the pre-finished contacts, the sintering technique making no direct contribution;

(c) the results relating to the interior of the contacts, such as the amount and status of foreign matter accommodated therein, indicate the quality of the powder starting materials (choice of Ag powder, WC powder) and the state of mixing of the starting materials are crucial and could explain restrike at a comparatively late stage in repeated current breaking operation.

It was hence established that although the time at which restrike occurs is apparently unrelated to the number of current breaking operations, the cause of restrike differs according to the time of its occurrence as in aforesaid (a), (b) and (c). This could also be an important factor in the dispersion in incidence of restrike in individual vacuum valves.

Accordingly, to suppress or reduce restrike at all times of its occurrence, it is necessary to select powder starting materials [silver (Ag) and tungsten carbide (WC)] of preferred quality and then crush, disperse and mix the said materials to obtain a uniform, finely divided silver-tungsten carbide powder mixture; and it is also important to obtain the benefits of a reduction in the formation of fine irregularities in the surface of the contacts due to closing and breaking and a reduction in ejection and dispersal of microscopic metal particles into the electrode space by incorporating prescribed amounts of carbon (C) and iron (Fe).

Working examples of the contacts material of the present invention will now be described.

Although the current chopping characteristic in vacuum valves wherein Ag—WC contacts are fitted generally improves when the amount of carbon present as an ancillary component is increased, the anti-restrike characteristic generally deteriorates. Improvement in the current chopping characteristic (a reduction therein and stabilization thereof) and reduction in the incidence of restrike in vacuum valves thus stand in a mutually conflicting relation, and to achieve both simultaneously, the present invention in essence requires for its effect that carbon present in a prescribed amount in the Ag—WC is held in an undissolved state or non-compound-forming state, that the amount of carbon is controlled to within the range 0.005–0.2%, and that the size of the carbon present in the contacts is controlled to within the range 0.01–10 $\mu$m (micrometer). Accordingly, the mean particle size and amount of carbon in the Ag—WC alloy contacts material are key points of the present invention.

The conditions for evaluation and the methods of evaluation demonstrating the benefits of the present invention are shown hereunder.

(1) Current chopping characteristic:

The specified contacts of diameter 20 mm, thickness 4 mm, flat on one side and with a curvature R of 50 mm on the other side, are mounted in a demountable vacuum circuit breaker apparatus for chopping current tests. The apparatus was exhausted to a vacuum of $10^{-3}$ Pa (pascal) or less and after clean-up of the contacts surface by baking, discharge aging, etc., contact opening is carried out at a speed of 0.8 m/s. The chopping current is found by observing the fall in voltage of a coaxial shunt inserted in series with the contacts via an LC circuit in initial make and break (1–100 switching operations) and late stage make and break (19,900–20,000 switching operations) at a current of 44 A r.m.s., 50 Hz (hertz). A relative comparison of the results was made taking the average chopping current in Working Example 5 as 1.0. The contacts material has a better current chopping characteristic the smaller the value of the chopping current and the smaller the width of dispersion therein.

(2) Restrike characteristic:

Disc contacts of diameter 30 mm, thickness 5 mm, were mounted in a demountable vacuum valve and the restrike frequency in 1–1,000 interruptions or 1,001–20,000 interruptions of a 50 Hz, 6 kV×500 A circuit was recorded in Tables 1–3 taking into account the dispersion between two circuit breakers (six vacuum valves).

TABLE 1

| Working Example or Comparative Example | composition of contacts (weight %) conditions | | | | | |
|---|---|---|---|---|---|---|
| | WC | amount of C in undissolved or non-compound-forming state | Co | Fe | ancillary component (anti-erosion component) | Ag |
| Comp.Ex.1 | 62 | <0.005 | 0.7 | nil | nil | balance |
| Work.Ex.1 | 62 | 0.005 | 0.7 | nil | nil | balance |
| Work.Ex.2 | 62 | 0.20 | 0.7 | nil | nil | balance |
| Comp.Ex.2 | 62 | 0.95 | 0.7 | nil | nil | balance |
| Work.Ex.3 | 62 | 0.075 | nil | nil | nil | balance |
| Work.Ex.4 | 62 | 0.075 | 0.7 | nil | nil | balance |
| Work.Ex.5 | 62 | 0.075 | 1.0 | nil | nil | balance |
| Work.Ex.6 | 62 | 0.075 | 3.0 | nil | nil | balance |
| Work.Ex.7 | 62 | 0.075 | 5.0 | nil | nil | balance |
| Comp.Ex.3 | 62 | 0.075 | 10.0 | nil | nil | balance |
| Work.Ex.8 | 62 | 0.075 | 0.7 | 0.01 | nil | balance |
| Work.Ex.9 | 62 | 0.075 | 0.7 | 0.1 | nil | balance |
| Work.Ex.10 | 62 | 0.075 | 0.7 | 0.5 | nil | balance |
| Comp.Ex.4 | 62 | 0.075 | 0.7 | 10.0 | nil | balance |
| Comp.Ex.5 | 36 | 0.075 | 0.7 | nil | nil | balance |
| Work.Ex.11 | 55 | 0.075 | 0.7 | nil | nil | balance |
| Work.Ex.12 | 70 | 0.075 | 0.7 | nil | nil | balance |
| Comp.Ex.6 | 85 | 0.075 | 0.7 | nil | nil | balance |
| Comp.Ex.7 | 62 | 0.075 | 0.7 | nil | nil | balance |
| Work.Ex.13 | 62 | 0.075 | 0.7 | nil | nil | balance |
| Work.Ex.14 | 62 | 0.075 | 0.7 | nil | nil | balance |
| Work.Ex.15 | 62 | 0.075 | 0.7 | nil | nil | balance |
| Comp.Ex.8 | 62 | 0.075 | 0.7 | nil | nil | balance |
| Work.Ex.16 | 62 | 0.075 | 0.7 | nil | nil | balance |
| Work.Ex.17 | 62 | 0.075 | 0.7 | nil | nil | balance |
| Work.Ex.18 | 62 | 0.075 | 0.7 | nil | nil | balance |
| Comp.Ex.9 | 62 | 0.075 | 0.7 | nil | nil | balance |
| Work.Ex.19 | 62 | 0.075 | 0.7 | nil | nil | balance |
| Work.Ex.20 | 62 | 0.075 | 0.7 | nil | nil | balance |
| Work.Ex.21 | 62 | 0.075 | 0.7 | nil | nil | balance |
| Comp.Ex.10 | 62 | 0.075 | 0.7 | nil | nil | balance |
| Work.Ex.22 | 62 | 0.075 | 0.7 | nil | Bi:0.15 | balance |
| Work.Ex.23 | 62 | 0.075 | 0.7 | nil | Sb:0.2 | balance |
| Work.Ex.24 | 62 | 0.075 | 0.7 | nil | Te:1.0 | balance |
| Comp.Ex.11 | 62 | 0.075 | 0.7 | nil | nil | balance |
| Comp.Ex.12 | 62 | 0.075 | 0.7 | nil | nil | balance |
| Work.Ex.25 | 62 | 0.075 | 0.7 | nil | nil | balance |
| Work.Ex.26 | 62 | 0.075 | 0.7 | nil | nil | balance |
| Work.Ex.27 | 62 | 0.075 | 0.7 | nil | nil | balance |
| Work.Ex.28 | 62 | 0.075 | 0.7 | nil | nil | balance |
| Work.Ex.29 | 62 | 0.075 | 0.7 | nil | nil | balance |
| Comp.Ex.13 | 62 | 0.075 | 0.7 | nil | nil | balance |

TABLE 2

| Working Example or Comparative Example | particle size (μm) conditions | | | | |
|---|---|---|---|---|---|
| | WC | Co | Fe | size of C in undissolved or non-compound-forming state, population mean | ancillary component (anti-erosion component) |
| Comp.Ex.1 | 0.8–1.0 | 5.0 | ... | 0.5 | ... |
| Work.Ex.1 | 0.8–1.0 | 5.0 | ... | 0.5 | ... |
| Work.Ex.2 | 0.8–1.0 | 5.0 | ... | 0.5 | ... |
| Comp.Ex.2 | 0.8–1.0 | 5.0 | ... | 0.5 | ... |
| Work.Ex.3 | 0.8–1.0 | nil | ... | 0.5 | ... |
| Work.Ex.4 | 0.8–1.0 | 5.0 | ... | 0.5 | ... |
| Work.Ex.5 | 0.8–1.0 | 5.0 | ... | 0.5 | ... |
| Work.Ex.6 | 0.8–1.0 | 5.0 | ... | 0.5 | ... |
| Work.Ex.7 | 0.8–1.0 | 5.0 | ... | 0.5 | ... |
| Comp.Ex.3 | 0.8–1.0 | 5.0 | ... | 0.5 | ... |
| Work.Ex.8 | 0.8–1.0 | 5.0 | 5.0 | 0.5 | ... |
| Work.Ex.9 | 0.8–1.0 | 5.0 | 5.0 | 0.5 | ... |
| Work.Ex.10 | 0.8–1.0 | 5.0 | 5.0 | 0.5 | ... |
| Comp.Ex.4 | 0.8–1.0 | 5.0 | 5.0 | 0.5 | ... |
| Comp.Ex.5 | 0.8–1.0 | 5.0 | ... | 0.5 | ... |
| Work.Ex.11 | 0.8–1.0 | 5.0 | ... | 0.5 | ... |
| Work.Ex.12 | 0.8–1.0 | 5.0 | ... | 0.5 | ... |
| Comp.Ex.6 | 0.8–1.0 | 5.0 | ... | 0.5 | ... |
| Comp.Ex.7 | <0.1 | 5.0 | ... | 0.5 | ... |
| Work.Ex.13 | 0.1 | 5.0 | ... | 0.5 | ... |
| Work.Ex.14 | 1.5 | 5.0 | ... | 0.5 | ... |
| Work.Ex.15 | 6 | 5.0 | ... | 0.5 | ... |
| Comp.Ex.8 | 12 | 5.0 | ... | 0.5 | ... |
| Work.Ex.16 | 0.8–1.0 | 0.1 | ... | 0.5 | ... |
| Work.Ex.17 | 0.8–1.0 | 3.0 | ... | 0.5 | ... |
| Work.Ex.18 | 0.8–1.0 | 10.0 | ... | 0.5 | ... |
| Comp.Ex.9 | 0.8–1.0 | 44.0 | ... | 0.5 | ... |
| Work.Ex.19 | 0.8–1.0 | 5.0 | ... | 0.01 | ... |
| Work.Ex.20 | 0.8–1.0 | 5.0 | ... | 0.1 | ... |
| Work.Ex.21 | 0.8–1.0 | 5.0 | ... | 5 | ... |
| Comp.Ex.10 | 0.8–1.0 | 5.0 | ... | 20 | ... |
| Work.Ex.22 | 0.8–1.0 | 5.0 | ... | 0.5 | 0.1–5 |
| Work.Ex.23 | 0.8–1.0 | 5.0 | ... | 0.5 | ... |
| Work.Ex.24 | 0.8–1.0 | 5.0 | ... | 0.5 | ... |
| Comp.Ex.11 | 0.8–1.0 | 5.0 | ... | 0.5 | ... |
| Comp.Ex.12 | 0.8–1.0 | 5.0 | ... | 0.5 | ... |
| Work.Ex.25 | 0.8–1.0 | 5.0 | ... | 0.5 | ... |
| Work.Ex.26 | 0.8–1.0 | 5.0 | ... | 0.5 | ... |
| Work.Ex.27 | 0.8–1.0 | 5.0 | ... | 0.5 | ... |
| Work.Ex.28 | 0.8–1.0 | 5.0 | ... | 0.5 | ... |
| Work.Ex.29 | 0.8–1.0 | 5.0 | ... | 0.5 | ... |
| Comp.Ex.13 | 0.8–1.0 | 5.0 | ... | 0.5 | ... |

TABLE 3

| Working Example or Comparative Example | degree of disprestion of C particles (gap between nearest neighbors conditions X: two nearest neighbours separated by more than diameter of grains L>d, Y: separated by diameter or more L d Z: grain diameter greater than gap L<d | surface of contact (surface that has a composition exhibiting the properties of contacts material) | |
|---|---|---|---|
| | | thickness (mm) | average roughness (Rave. μm) |
| Comp.Ex.1 | X | 3 | 0.3 |
| Work.Ex.1 | X | 3 | 0.3 |
| Work.Ex.2 | X~Y | 3 | 0.3 |
| Comp.Ex.2 | X~Y | 3 | 0.3 |
| Work.Ex.3 | X | 3 | 0.3 |
| Work.Ex.4 | X | 3 | 0.3 |
| Work.Ex.5 | X | 3 | 0.3 |
| Work.Ex.6 | X | 3 | 0.3 |
| Work.Ex.7 | X | 3 | 0.3 |
| Comp.Ex.3 | X | 3 | 0.3 |

TABLE 3-continued

| Working Example or Comparative Example | degree of dispretion of C particles (gap between nearest neighbors conditions X: two nearest neighbours separated by more than diameter of grains L>d, Y: separated by diameter or more L d Z: grain diameter greater than gap L<d | surface of contact (surface that has a composition exhibiting the properties of contacts material) thickness (mm) | average roughness (Rave. μm) |
|---|---|---|---|
| Work.Ex.8 | X | 3 | 0.3 |
| Work.Ex.9 | X | 3 | 0.3 |
| Work.Ex.10 | X | 3 | 0.3 |
| Comp.Ex.4 | X | 3 | 0.3 |
| Comp.Ex.5 | X | 3 | 0.3 |
| Work.Ex.11 | X | 3 | 0.3 |
| Work.Ex.12 | X | 3 | 0.3 |
| Comp.Ex.6 | X | 3 | 0.3 |
| Comp.Ex.7 | X~Y | 3 | 0.3 |
| Work.Ex.13 | X~Y | 3 | 0.3 |
| Work.Ex.14 | X~Y | 3 | 0.3 |
| Work.Ex.15 | X~Y | 3 | 0.3 |
| Comp.Ex.8 | X~Y | 3 | 0.3 |
| Work.Ex.16 | X~Y | 3 | 0.3 |
| Work.Ex.17 | X~Y | 3 | 0.3 |
| Work.Ex.18 | X~Y | 3 | 0.3 |
| Comp.Ex.9 | X~Y | 3 | 0.3 |
| Work.Ex.19 | X~Y | 3 | 0.3 |
| Work.Ex.20 | X~Y | 3 | 0.3 |
| Work.Ex.21 | X~Y | 3 | 0.3 |
| Comp.Ex.10 | X~Y | 3 | 0.3 |
| Work.Ex.22 | X~Y | 3 | 0.3 |
| Work.Ex.23 | X~Y | 3 | 0.3 |
| Work.Ex.24 | X~Y | 3 | 0.3 |
| Comp.Ex.11 | Z | 3 | 0.3 |
| Comp.Ex.12 | X | 0.1 | 0.3 |
| Work.Ex.25 | X | 0.3 | 0.3 |
| Work.Ex.26 | X | 6.0 | 0.3 |
| Work.Ex.27 | X | 3 | 0.05 |
| Work.Ex.28 | X | 3 | 1.0 |
| Work.Ex.29 | X | 3 | 10.0 |
| Comp.Ex.13 | X | 3 | 25.0 |

Only baking heat (450° C.×30 min) was applied in mounting the contacts; no brazing material was used and no heating associated therewith was applied. The results of the measurements have been indicated as upper and lower limits to take account of dispersion. A material has a better restrike characteristic the lower the frequency of restrike and the smaller the range of dispersion.

(3) Arc erosion resistance:

The contacts were mounted in a demountable vacuum circuit breaker apparatus, and the contact electrode surface baking, current, and voltage aging conditions and the contact separation speed were held constant and identical; the weight loss was then calculated from the surface irregularities before and after 1000 interruptions of a 7.2 kV, 4.4 kA circuit. A relative comparison was made taking the value in Working Example 5 as 1.0.

(4) Examples of method of production of contacts:

Examples of the production of the contacts of the present invention will be described. Methods of producing the contacts material divide broadly into an infiltration process whereby silver (Ag) is melted and flushed into a skeleton composed of tungsten carbide (WC) and carbon (C), and a sintering process whereby a powder derived by mixing tungsten carbide (WC), carbon powder and silver powder in prescribed proportions is sintered or pressed and then sintered.

It is heretofore known that when the amount of carbon in silver-tungsten carbide alloy is increased, the frequency of restrike increases (the restrike characteristic declines). Since the presence of carbon is thus considered conducive to restrike, the present invention reconciles the current chopping characteristic and the restrike characteristic by optimizing the state of the carbon in the silver-tungsten carbide alloy. Hence, the method of alloying the carbon into the silver-tungsten carbide alloy is important since it dictates the state in which carbon occurs.

Since the amount of carbon is small compared with the amounts of tungsten carbide and silver, alloying of carbon into silver-tungsten carbide alloy requires good homogeneous mixing. As a means thereof, a first powder mixture is obtained, for example, by taking a very small part of the amount of tungsten carbide ultimately required (55–70 weight %) and mixing it with carbon powder (if necessary, with the further addition of at least one of bismuth Bi, antimony Sb and tellurium Te, hereinafter represented as Bi; iron Fe and cobalt Co may be similarly treated) to obtain a first powder mixture (the operation being repeated to the n.th mixing if necessary). The first powder mixture (or n.th powder mixture) is re-mixed with the remaining tungsten carbide powder, ultimately affording [tungsten carbide, carbon (wC,C)] powder in a perfectly satisfactory state of mixing. The [wC,C] powder is mixed with the prescribed amount of silver powder and the Ag—WC—C contacts stock material or Ag—WC—C contacts stock material (or Ag—WC—Co—C, Ag—WC—Fe—C, Ag—WC—Co—Fe—C or Ag—WC—Co—C—Bi contacts stock material, etc.; hereinafter represented by Ag—WC—C) is then produced by combining once, or a plurality of times, sintering and pressing at a temperature of, for example, 930° C. in a hydrogen atmosphere (treatment in vacuum also being permissible), and processed to the prescribed geometry to provide contacts. As a different method of alloying, a first powder mixture is obtained by taking a very small part of the amount of silver (if necessary with the addition of Bi; and if necessary, also with the addition of iron Fe and/or cobalt Co) ultimately required and mixing it with carbon powder (the operation being repeated to the n.th mixing if necessary). The first powder mixture (or n.th powder mixture) is re-mixed with the remainder of the silver powder, ultimately affording [silver, carbon (Ag,C)] powder in a perfectly satisfactory state of mixing.

The [Ag,C] powder was mixed with the prescribed amount of WC powder (the amount of WC ultimately required) and the Ag—WC—C contacts stock material or Ag—WC—C—Bi contacts stock material was then produced by combining once, or a plurality of times, sintering and pressing at a temperature of, for example, 940° C. in a hydrogen atmosphere (treatment in vacuum also being permissible). (Production Example 2)

As another method of production, a [WC,C] skeleton of prescribed porosity was made from the aforesaid [WC,C] or [WC,Co,C] n.th powder mixture product by sintering at a temperature of 120° C., and Ag—WC—C contacts stock material or Ag—WC—C—Bi contacts stock material was then produced by infiltrating the pores in the said skeleton with Ag (if necessary with the addition of Bi) at a temperature of, for example, 1050° C. (Production Example 3)

As yet another method of alloying, a skeleton of prescribed porosity was made by sintering [WC,C] powder or [WC,Co,C] powder at a temperature of 1500° C. and Ag—WC—C contacts stock material was then produced by infiltrating the pores in the said skeleton with separately prepared Ag at a temperature of, for example, 1050° C. (if necessary, Ag—WC—C—Bi contacts stock material was produced by addition of Bi to the aforesaid Ag—WC—C).

(Production Example 4)

As yet another method of alloying, a WC powder was obtained wherein the surface of tungsten had been coated with carbon (and Bi at the same time if necessary) by a physical process using ion plating apparatus or sputtering apparatus, or by a mechanical process using ball-milling apparatus; the coated WC powder was mixed with Ag powder (Bi being added at the same time, if necessary), and Ag—WC—C contacts stock material or Ag—WC—C—Bi contacts stock material was then produced by combining once, or a plurality of times, sintering and pressing at a temperature of, for example, 1060° C. in a hydrogen atmosphere (treatment in vacuum also being permissible).

(Production Example 5)

As yet another method of alloying, superimposition of rocking vibration and stirring motion is advantageous, especially in the art of uniformly mixing Ag powder, WC powder and C powder. This eliminates the phenomenon of compaction and formation of agglomerates in the mixed powder, seen in the generally applied use of solvents such as acetone, and improves processability.

Energy input to the powder during crushing, dispersion and mixing lies within the preferred range if the ratio R/S of the frequency R of stirring motion of the agitating vessel in the mixing operation and the frequency S of rocking vibration applied to the agitating vessel is selected from the preferred range of approximately 10–0.1, with the special merit that the level of alteration or contamination of the powder in the mixing operation can be kept low.

Mixing and pulverization with a conventional mixer, etc., imposes a crushing action on the powder, but since the aforementioned ratio R/S is distributed in the range approximately 10–0.1 in the present method whereby rocking vibration and stirring motion are superimposed, mixing simply intermingles the respective powders, and good porosity is maintained, sinterability improves and a good quality compact or sintered compact or skeleton is obtained.

Furthermore, since no more energy is input than is necessary, the powder experiences no modification. The use of a powder mixture in this state affords a reduction in gas in the alloy after sintering and infiltration and contributes to stabilization of current interruption performance and restrike characteristic.

(Production Example 6)

The method of production employed in the working examples of the present invention was chosen as appropriate; contacts material exhibiting the benefits of the present invention are obtainable whichever of the techniques is chosen.

Working examples of the present invention are hereunder described in detail.

WORKING EXAMPLES 1–2, COMPARATIVE EXAMPLES 1–2

Assembly of the experimental valve for the circuit breaking tests will first be outlined. A ceramic insulating vessel (main component: $Al_2O_3$) with the end faces polished to an average roughness of approximately 1.5 $\mu$m was prepared, and the ceramic insulating vessel was subjected to pre-heat treatment at 1650° C. prior to assembly.

42% Ni—Fe alloy sheet of thickness 2 mm was prepared as sealing metal. 72% Ag—Cu alloy sheet of thickness 0.1 mm was prepared as brazing material. The parts so prepared were arranged so as to allow airtight sealing between the parts to be joined (the end faces of the ceramic insulating vessel and the sealing metal) and the sealing metal and ceramic insulating vessel were subjected to airtight sealing in a vacuum atmosphere of $5\times10^{-4}$ Pa.

The contacts materials tested, the content of the evaluation, and the results are shown in Table 1 through to Table 7.

TABLE 4

| Working Example or Comparative Example | current chopping characteristic, interruption of 50 Hz, 44 A (r.m.s.) circuit conditions | | | |
|---|---|---|---|---|
| | characteristic in 1–100 make and break operations | | characteristic in 19,900–20,000 make and break operations | |
| | average | maximum | average | maximum |
| Comp.Ex.1 | 1.2 | 1.5 | 1.4 | 1.9 |
| Work.Ex.1 | 1.05 | 1.3 | 1.2 | 1.3 |
| Work.Ex.2 | 0.9 | 1.1 | 1.0 | 1.2 |
| Comp.Ex.2 | 0.85 | 1.0 | 1.0 | 1.1 |
| Work.Ex.3 | 0.95 | 1.0 | 1.15 | 1.25 |
| Work.Ex.4 | 1.0 | 1.1 | 1.25 | 1.35 |
| Work.Ex.5 | 1.1 | 1.2 | 1.3 | 1.4 |
| Work.Ex.6 | 1.2 | 1.4 | 1.36 | 1.5 |
| Work.Ex.7 | 1.3 | 1.6 | 1.4 | 1.8 |
| Comp.Ex.3 | 2.04 | 3.3 | 2.8 | 4.6 |
| Work.Ex.8 | 0.95 | 1.05 | 1.15 | 1.3 |
| Work.Ex.9 | 1.0 | 1.0 | 1.0 | 1.3 |
| Work.Ex.10 | 1.1 | 1.2 | 1.2 | 1.4 |
| Comp.Ex.4 | 2.6 | 3.0 | 3.6 | 5.2 |
| Comp.Ex.5 | 1.6 | 2.0 | 1.8 | 2.4 |
| Work.Ex.11 | 1.1 | 1.2 | 1.4 | 1.55 |
| Work.Ex.12 | 0.9 | 1.0 | 1.2 | 1.3 |
| Comp.Ex.6 | 0.75 | 0.95 | 1.1 | 1.2 |
| Comp.Ex.7 | 0.9 | 1.0 | -- | -- |
| Work.Ex.13 | 0.95 | 1.05 | 1.2 | 1.3 |
| Work.Ex.14 | 1.05 | 1.15 | 1.2 | 1.3 |
| Work.Ex.15 | 1.1 | 1.25 | 1.4 | 1.6 |
| Comp.Ex.8 | 1.2 | 1.6 | 1.5 | 4.6 |
| Work.Ex.16 | 0.9 | 1.0 | 1.0 | 1.1 |
| Work.Ex.17 | 0.8 | 1.0 | 1.0 | 1.15 |
| Work.Ex.18 | 1.2 | 1.45 | 1.55 | 1.75 |
| Comp.Ex.9 | 1.8 | 2.5 | 1.7 | 3.2 |
| Work.Ex.19 | 0.95 | 1.15 | 1.2 | 1.3 |
| Work.Ex.20 | 1.0 | 1.1 | 1.25 | 1.35 |
| Work.Ex.21 | 1.0 | 1.7 | 1.4 | 1.9 |
| Comp.Ex.10 | 1.0 | 2.6 | 2.8 | 4.8 |
| Work.Ex.22 | 0.95 | 1.05 | 1.2 | 1.3 |
| Work.Ex.23 | 0.95 | 1.05 | 1.2 | 1.3 |
| Work.Ex.24 | 0.95 | 1.05 | 1.2 | 1.3 |
| Comp.Ex.11 | 1.2 | 1.45 | 1.4 | 3.45 |
| Comp.Ex.12 | 1.0 | 1.1 | -- | -- |
| Work.Ex.25 | 1.0 | 1.1 | 1.25 | 1.35 |
| Work.Ex.26 | 1.0 | 1.1 | 1.25 | 1.35 |
| Work.Ex.27 | 1.0 | 1.1 | 1.25 | 1.35 |
| Work.Ex.28 | 1.0 | 1.1 | 1.25 | 1.35 |
| Work.Ex.29 | 1.2 | 1.5 | 1.25 | 1.35 |
| Comp.Ex.13 | 1.4 | 1.9 | 1.45 | 3.1 |

TABLE 5

| Working Example or Comparative Example | incidence of restrike (%) conditions: frequency of restrike in 1000 interruptions of 6 kV × 500 A circuit, two circuit breakers (upper limit-lower limit of 6 values as vacuum valves) × $10^{-3}$(%) | frequency of restrike in 20,000 interruptions of 6 kV of 500 A circuit, two circuit breakers (upper limit-lower limit of 6 values as vacuum valves) × $10^{-3}$(%) |
|---|---|---|
| Comp.Ex.1 | 18~80 | 45~104 |
| Work.Ex.1 | 0~12 | 4~13 |
| Work.Ex.2 | 7~15 | 13~20 |
| Comp.Ex.2 | 61~86 | 85~162 |
| Work.Ex.3 | 6~16 | 10~18 |
| Work.Ex.4 | 4~14 | 8~17 |
| Work.Ex.5 | 10~18 | 14~22 |
| Work.Ex.6 | 17~26 | 21~26 |
| Work.Ex.7 | 21~31 | 24~28 |
| Comp.Ex.3 | 27~50 | 34~71 |
| Work.Ex.8 | 5~16 | 10~19 |
| Work.Ex.9 | 12~22 | 13~25 |
| Work.Ex.10 | 11~20 | 15~25 |
| Comp.Ex.4 | 30~66 | 41~93 |
| Comp.Ex.5 | 17~48 | 26~77 |
| Work.Ex.11 | 5~11 | 8~16 |
| Work.Ex.12 | 6~16 | 10~16 |
| Comp.Ex.6 | 38~82 | 52–214 |
| Comp.Ex.7 | lacks stability in mass production of contacts | --- |
| Work.Ex.13 | 5~10 | 6~15 |
| Work.Ex.14 | 10~17 | 13~20 |
| Work.Ex.15 | 12~23 | 15~25 |
| Comp.Ex.8 | 16~55 | 22~93 |
| Work.Ex.16 | 8~15 | 15~25 |
| Work.Ex.17 | 7~14 | 11~18 |
| Work.Ex.18 | 17~26 | 24~33 |
| Comp.Ex.9 | 44~83 | 121~292 |
| Work.Ex.19 | 3~12 | 6~14 |
| Work.Ex.20 | 5~10 | 8~16 |
| Work.Ex.21 | 12~18 | 16~28 |
| Comp.Ex.10 | 18~38 | 66~115 |
| Work.Ex.22 | 3~12 | 10~28 |
| Work.Ex.23 | 6~16 | 20~28 |
| Work.Ex.24 | 8~18 | 21~35 |
| Comp.Ex.11 | 8~14 | 80~228 |
| Comp.Ex.12 | cracking & failure of contacts during repeated make and break operation | --- |
| Work.Ex.25 | 5~14 | 8~18 |
| Work.Ex.26 | 5~14 | 10~18 |
| Work.Ex.27 | 4~16 | 6~18 |
| Work.Ex.28 | 6~18 | 11~18 |
| Work.Ex.29 | 21~32 | 27~44 |
| Comp.Ex.13 | 16~282 | 28~468 |

TABLE 6

| Working Example or Comparative Example | erosion resistance test conditions: weight loss in 1000 interruptions of 7.2 kV, 4.4 kA circuit, scaling factor (relative value taking result in Working Example 4 as 1.0) |
|---|---|
| Comp.Ex.1 | 0.85 ~ 1.0 |
| Work.Ex.1 | 0.9 ~ 1.1 |
| Work.Ex.2 | 1.4 ~ 2.5 |
| Comp.Ex.2 | 7.7 ~ 11.3 |
| Work.Ex.3 | 2.2 ~ 3.7 |
| Work.Ex.4 | 1.0 |
| Work.Ex.5 | 0.9 ~ 1.6 |
| Work.Ex.6 | 1.4 ~ 1.9 |
| Work.Ex.7 | 1.6 ~ 2.3 |
| Comp.Ex.3 | 4.1 ~ 9.7 |
| Work.Ex.8 | 1.0 ~ 1.1 |

TABLE 6-continued

| Working Example or Comparative Example | erosion resistance test conditions: weight loss in 1000 interruptions of 7.2 kV, 4.4 kA circuit, scaling factor (relative value taking result in Working Example 4 as 1.0) |
|---|---|
| Work.Ex.9 | 1.0 ~ 1.6 |
| Work.Ex.10 | 1.2 ~ 1.7 |
| Comp.Ex.4 | 5.5 ~ 16.2 |
| Comp.Ex.5 | 1.05 ~ 1.25 |
| Work.Ex.11 | 0.9 ~ 1.15 |
| Work.Ex.12 | 1.1 ~ 1.25 |
| Comp.Ex.6 | 6.9 ~ 8.3 |
| Comp.Ex.7 | 1.25 ~ 6.8 |
| Work.Ex.13 | 1.0 ~ 1.05 |
| Work.Ex.14 | 1.05 ~ 1.15 |
| Work.Ex.15 | 2.4 ~ 2.9 |

TABLE 6-continued

| Working Example or Comparative Example | erosion resistance test conditions: weight loss in 1000 interruptions of 7.2 kV, 4.4 kA circuit, scaling factor (relative value taking result in Working Example 4 as 1.0) |
|---|---|
| Comp.Ex.8 | 10.6 ~ 18.4 |
| Work.Ex.16 | 0.95 ~ 1.25 |
| Work.Ex.17 | 0.95 ~ 1.2 |
| Work.Ex.18 | 3.2 ~ 4.6 |
| Comp.Ex.9 | 14.7 ~ 24.9 |
| Work.Ex.19 | 0.75 ~ 0.9 |
| Work.Ex.20 | 0.85 ~ 1.0 |
| Work.Ex.21 | 1.4 ~ 1.8 |
| Comp.Ex.10 | 20.4 ~ 44.2 |
| Work.Ex.22 | 1.25 ~ 1.65 |
| Work.Ex.23 | 1.45 ~ 1.85 |
| Work.Ex.24 | 1.55 ~ 2.2 |
| Comp.Ex.11 | 2.1 ~ 18.4 |
| Comp.Ex.12 | --- |
| Work.Ex.25 | 0.9 ~ 1.1 |
| Work.Ex.26 | 0.9 ~ 1.1 |
| Work.Ex.27 | 0.9 ~ 1.1 |
| Work.Ex.28 | 0.95 ~ 1.15 |
| Work.Ex.29 | 1.2 ~ 1.4 |
| Comp.Ex.13 | 4.4 ~ 19.6 |

TABLE 7

| Working Example or Comparative Example | remarks conditions: behaviour of material (findings in microscopic examination of surface after evaluation test) | overall assessment good: ○, unsatisfactory: X |
|---|---|---|
| Comp.Ex.1 | | X |
| Work.Ex.1 | | ○ |
| Work.Ex.2 | | ○ |
| Comp.Ex.2 | large Ag loss by ejection; shedding of C | X |
| Work.Ex.3 | | ○ |
| Work.Ex.4 | | ○ |
| Work.Ex.5 | | ○ |
| Work.Ex.6 | | ○ |
| Work.Ex.7 | | ○ |
| Comp.Ex.3 | segregation of C | X |
| Work.Ex.8 | | ○ |
| Work.Ex.9 | | ○ |
| Work.Ex.10 | | ○ |
| Comp.Ex.4 | excess Fe aggregates & coarsens C | X |
| Comp.Ex.5 | Ag aggregates on contacts surface | X |
| Work.Ex.11 | | ○ |
| Work.Ex.12 | | ○ |
| Comp.Ex.6 | Ag absent from parts of contacts surface; aggregation & shedding of Wc | X |
| Comp.Ex.7 | evaluation tests aborted | X |
| Work.Ex.13 | | ○ |
| Work.Ex.14 | | ○ |
| Work.Ex.15 | | ○ |
| Comp.Ex.8 | aggregation of WC; Ag-depleted areas | X |
| Work.Ex.16 | aggregation of WC and Co; Ag-depleted areas | ○ |
| Work.Ex.17 | | ○ |
| Work.Ex.18 | | ○ |
| Comp.Ex.9 | | X |
| Work.Ex.19 | aggregation of C; C-depleted areas | ○ |
| Work.Ex.20 | | ○ |
| Work.Ex.21 | | ○ |
| Comp.Ex.10 | | X |
| Work.Ex.22 | | ○ |
| Work.Ex.23 | | ○ |
| Work.Ex.24 | | ○ |

TABLE 7-continued

| Working Example or Comparative Example | remarks conditions: behaviour of material (findings in microscopic examination of surface after evaluation test) | overall assessment good: ○, unsatisfactory: X |
|---|---|---|
| Comp.Ex.11 | | X |
| Comp.Ex.12 | evaluation tests aborted | X |
| Work.Ex.25 | | ○ |
| Work.Ex.26 | | ○ |
| Work.Ex.27 | | ○ |
| Work.Ex.28 | | ○ |
| Work.Ex.29 | | ○ |
| Comp.Ex.13 | | X |

Starting materials of mean particle size WC 0.8–1.0 μm, C 0.5 μm and Co 5 μm were prepared and 62 weight % WC—Co—C-balance Ag contacts materials were produced at 1100° C. from WC—C powder mixture by the methods of the aforementioned Production Examples 1–6, chosen as appropriate.

The contacts materials used in fabricating the test contacts were Ag—WC alloys containing an amount of carbon in an undissolved state or non-compound-forming state of less than 0.005% (Comparative Example 1), 0.005–0.20% (Working Examples 1–2) and 0.95% (Comparative Example 2), chosen on the basis of microstructural examination.

The materials were processed into specimens of the prescribed geometry, thickness 3 mm and average roughness of the surface of contact 0.3 μm, and the current chopping characteristic, restrike characteristic and erosion resistance were measured. The specimen details are given in Table 1 through to Table 3 and the evaluation conditions and results are given in Tables 4 through to Table 7.

As will be seen from Tables 1 to 7, Ag—WC alloy with a carbon content of less than 0.005% (Comparative Example 1) has a desirable current chopping characteristic and low range of variation therein within the allowable range in comparison of the initial make and break (1–100 switching operations) and late stage make and break (19,900–20,000 switching operations), and also gave satisfactory arc erosion resistance. On the other hand, the restrike characteristic in 20,000 interruptions of a 6 kV×500 A circuit was undesirable in that, compared with the incidence in 1000 interruptions, the incidence of restrike was markedly increased and the width of dispersion therein was much larger.

Microscopic examination of the surface revealed that in contacts evaluated for restrike characteristic in 20,000 switching operations, slight surface irregularities representing surface damage due to carbon deficit and vestiges of silver dispersal were present over a wide area of the contacts surface.

In contrast, Ag—WC alloy of carbon content 0.005–0.20% (Working Examples 1–2) gave a incidence of restrike in the allowable range of not more than $0–20\times10^{-3}$% while the current chopping characteristic was also in the desirable range of 0.9–1.3 A and the arc erosion resistance was in the allowable range of relative values 0.9–2.5, the material exhibiting stable characteristics in respect of current chopping, restrike and arc erosion resistance with increase in the number of switching operations. Microscopic examination of the contacts surface after evaluation of the restrike characteristic in 20,000 switching operations revealed that the surface of the contacts was in a smoother state than in the aforesaid Comparative Example 1 over a wide range owing to the carbon distributing effect of the prescribed conditions.

The Ag—WC alloy with a carbon content of 0.95% (Comparative Example 2) gave a desirable current chopping characteristic and low range of variation therein within the allowable range in comparison of initial make and break (1–100 switching operations) and late stage make and break (19,900–20,000 switching operations) but the arc erosion resistance of the contacts in 1000 interruptions of a 7.2 kV×4.4 kA circuit was markedly poorer, with a large dispersion in values between contacts, compared with Working Examples 1–2 and Comparative Example 1; and the restrike characteristic in 20,000 interruptions of a 6 kV×500 A circuit was undesirable in that, compared with the frequency in 1000 interruptions, the incidence of restrike was markedly increased and the width of dispersion therein was much larger.

Microscopic examination of the surface of contacts evaluated for restrike characteristic in 20,000 switching operations revealed the presence of marked surface irregularities showing the vestiges of ejection and volatilization of silver over a wide area; moreover, gross surface irregularities due to shedding of carbon were observed in the current breaking surface. Hence, the benefit of the present invention is displayed when the amount of carbon in an undissolved state or non-compound-forming state in the Ag—WC alloy is in the range 0.005–0.2%.

Moreover, the current chopping characteristic at the same carbon content of 0.20% in the Ag—WC as in the aforesaid Working Example 2 deteriorates when the amount of carbon in an undissolved state or non-compound-forming state is less than the 0.005% shown in Working Example 1 despite the material maintaining a comparable arc erosion resistance and restrike characteristic; this is undesirable in disrupting the balance between current chopping characteristic, restrike characteristic and arc erosion resistance. Thus, Ag—WC alloy of carbon content 0.005–0.20% was very undesirable [sic] in regard to a high incidence of restrike, large contacts erosion loss, and decline in current chopping characteristic, a carbon content in the range 0.005–0.2% (Working Examples 1–2) giving overall stability in respect of the aims of the present invention.

Observations also showed that, at the same carbon content in the Ag—WC alloy, the presence of the prescribed amount of carbon in an undissolved state or not forming compounds such as carbides was advantageous in obtaining a low incidence of restrike and small width of dispersion therein while maintaining the current chopping characteristic even after a large number of switching operations. This shows that the amount of carbon in an undissolved state or non-compound-forming state, not the total amount of carbon, is important. In contrast, roughening of the surface of the contacts tended to increase and the incidence of restrike increased with increase in the number of switching operations in Ag—WC wherein the carbon was in solid solution or had formed compounds. A large dispersion in incidence of restrike was observed between duplicate materials. An increase in contact erosion was also seen.

WORKING EXAMPLES 3–7, COMPARATIVE EXAMPLE 3

The foregoing Working Examples 1–2 and Comparative Examples 1–2 showed the benefit of the present invention when the cobalt content was held constant at 0.7% at a carbon content in the Ag—WC alloy of less than 0.005%, and at a carbon content in the alloy of 0.005–0.95%. However, the benefit of the present invention is not displayed exclusively at that cobalt content. Thus, similar evaluation of 62% WC-balance Ag alloys wherein the cobalt content was set at zero and 0.7–10% (Working Examples 3–7) showed that the incidence of restrike was in the desirable range of $4–31\times10^{-3}$; in particular there was no marked difference in comparison at 1000 current interruptions and 20,000 current interruptions and the dispersion in frequency was small. Erosion was in the range 0.9–2.3% and the chopping current was in the range 0.95–1.8 A, indicating stable restrike, current chopping and erosion resistance characteristics. Accordingly, the present invention is effective in regard to balancing the restrike characteristic, current chopping characteristic and erosion resistance of Ag—WC contacts and Ag—WC—Co contacts.

However, when a similar evaluation was made of 62% WC-balance Ag alloy wherein the amount of cobalt was set at 10% (Comparative Example 3), the chopping current greatly increased (the characteristic deteriorated). This was attributed to the decrease in conductivity of the alloy itself and the reduced thermionic emission capability of the WC itself due to the presence of 10% of cobalt.

Furthermore, comparing the incidence of restrike in Comparative Example 3 taking the incidence of restrike in 1000 and 20,000 current interruptions in the aforesaid Working Example 4 as a reference basis, the frequency in Comparative Example 3 increased by a factor of 3–7 at 1000 interruptions and a factor of 5–8 at 20,000 interruptions (the characteristic deteriorated).

The results of microscopic examination suggested that the presence of more than the prescribed amount of cobalt produces excess cobalt in the alloy structure and tends to aggregate and coarsen the carbon in the structure, segregation of carbon in this way resulting in an increased incidence of restrike. Accordingly, the art of the present invention for obtaining a balance in restrike characteristic, current chopping characteristic and arc erosion resistance is displayed to effect in Ag—WC contacts wherein the cobalt content of 5% in Working Example 7 is made the upper limit (including the case where the cobalt content is zero, shown in the aforesaid Working Example 1).

WORKING EXAMPLES 8–10, COMPARATIVE EXAMPLE 4

The foregoing Working Examples 1–7 show the benefit of the present invention when the iron content of the Ag—WC alloy is set at zero and the cobalt content is set at 0–5%. However, the benefit of the present invention is not displayed exclusively thereby. Thus, in 62% WC-balance Ag alloy wherein the cobalt content is set at 0.7% and the iron content is set at 0.01–0.5% (Working Examples 8–10), the incidence of restrike was $5–25\times10^{-3}$(%), erosion was 1.0–1.7% or less, and the chopping current was 0.95–1.4 A, indicating stable restrike, current chopping and erosion resistance characteristics comparable with those in Working Example 4 serving as standard.

However, when a similar evaluation was made for 62%WC-balance Ag alloy wherein the amount of iron was set at 10% (Comparative Example 4), the chopping current increased greatly in both in 1–100 switching operations and 19,900–20,000 switching operations (the characteristic deteriorated). This was attributed to the decrease in conductivity of the alloy itself and the reduced thermionic emission capability of the WC itself due to the presence of 10% of iron. Furthermore, comparing the incidence of restrike in Comparative Example 4 taking the incidence of restrike in 1000 and 20,000 current interruptions in the aforesaid Working Example 4 as the basis of comparison, the frequency in Comparative Example 4 increased by a factor of 4–7.5 at 1000 and factor of 5–8 at 20,000 (the characteristic deteriorated).

The results of microscopic examination suggested that the presence of more than the prescribed amount of iron produces excess iron in the alloy structure and tends to aggregate and coarsen the carbon in the structure, segregation of carbon in this way resulting in an increased incidence of restrike. Accordingly, the art of the present invention for obtaining a balance in restrike characteristic, current chopping characteristic and arc erosion resistance is displayed to effect in Ag—WC contacts wherein the iron content of 0.5 weight % shown in Working Example 10 is made the upper limit.

WORKING EXAMPLES 11–12, COMPARATIVE EXAMPLES 5–6

The foregoing Working Example 1–10 and Comparative Examples 1–4 show the benefit of the present invention when the WC content of the Ag—WC, Ag—WC—Co or Ag—WC—Co—Fe alloy was set at 62%. However, the benefit of the present invention is not displayed exclusively at that WC content. Thus, when the WC content was set at 55–75%, essentially the same good characteristics were exhibited in current chopping, incidence of restrike and erosion resistance as in the Working Example 4 serving as standard. (Working Examples 9–10)

When a similar evaluation was made for 0.7% Co-balance Ag wherein the amount of WC was set at 36% (Comparative Example 5), the erosion factor of 1.05–1.25 compared with Working Example 4 serving as standard was within the desirable range. However, although there was no deterioration in characteristic in the range 1–100 switching operations, some increase, by a factor of about 2, was seen in the chopping current in 19,900–20,000 switching operations (a deterioration in characteristic).

Moreover, a large increase and dispersion in the incidence of restrike (deterioration in characteristic) were seen. Thus, comparing the incidence of restrike in Comparative Example 4 taking the incidence of restrike in 1000 and 20,000 current interruptions in the aforesaid Working Example 4 as the basis of comparison, the frequency in Comparative Example 5 increased by a factor of 3 at 1000 and factor of 2–4.5 at 20,000 (the characteristic deteriorated). Aggregation of silver on the surface of the contacts was seen in microscopic examination.

When a similar evaluation was made for WC-balance Ag alloy wherein the amount of WC was set at 85% (Comparative Example 6), on the other hand, the chopping current in 1–100 switching operations and 19,900–20,000 switching operations indicated the same or better, extremely good characteristic as in Working Example 4 serving as standard but a large increase and dispersion in the incidence of restrike and erosion (deterioration in characteristics) were seen.

Thus, comparing the incidence of restrike in Comparative Example 6 taking the incidence of restrike in 1000 and 20,000 current interruptions in the aforesaid Working Example 4 as the basis of comparison, the frequency in Comparative Example 6 increased greatly by a factor of 5–10 at 1000 and factor of 6–12 at 20,000 (the characteristic deteriorated). Scattered areas wherein silver was absent from the surface, and aggregation and shedding of WC, were seen in microscopic examination of the surface of the contacts. Accordingly, the art of the present invention for obtaining a balance in the restrike characteristic, current chopping characteristic and erosion resistance is displayed to effect at the WC content of 55–75% shown in Working Examples 9–10.

WORKING EXAMPLES 13–15, COMPARATIVE EXAMPLES 7–8

The foregoing Working Examples 1–12 and Comparative Examples 1–6 show the benefit of the present invention when the WC in the Ag—WC, Ag—WC—Co or Ag—WC—Co—Fe alloy has a mean particle size (diameter when the particles are viewed as spheres) of 0.8–1.0 μm. However, the benefit of the present invention is not displayed exclusively at that mean particle size.

Thus, when a similar evaluation was made with the mean particle size of the WC set 0.1–6 @m, essentially the same good characteristics were exhibited in regard to current chopping, frequency of restrike and arc erosion resistance as in the Working Example 4 serving as standard. (Working Examples 13–15)

However, in a similar evaluation of 62% WC—Co-balance Ag wherein the mean particle size of the WC was set at 12 μm (Comparative Example 8), the arc erosion resistance showed a great deterioration, erosion increasing 10–18 fold compared with the Working Example 4 serving as standard. Furthermore, although there was no decline in the current chopping characteristic compared with Working Example 4 in the range 1–100 switching operations, the chopping current increased by a factor of 1.5–4.6 (the characteristic deteriorated) in 19,900–20,000 switching operations. A large increase in the incidence of restrike (a deterioration in characteristic) and a large dispersion therein were also seen.

Thus, comparing the incidence of restrike in Comparative Example 8 taking the incidence of restrike in 1000 and 20,000 current interruptions in the aforesaid Working Example 4 as the basis of comparison, the frequency in Comparative Example 8 increased greatly by a factor of 3–5 at 1000 and factor of 3–5 at 20,000 (the characteristic deteriorated). Microscopic examination showed aggregation of WC and Ag-depleted areas in the surface of the contacts.

Contacts alloy of good quality was difficult to obtain with 62% WC-balance Ag wherein the mean particle size of the WC was set at less than 0.1 μm (Comparative Example 7) owing to the residual porosity and large gas content of the contacts alloy; as a result, cracking and rupture occurred in the contacts during evaluation and the evaluation was aborted. It is hence desirable that the mean particle size of the WC in the Ag—WC—Co alloy should be chosen from the range 0.1–6 μm.

In selecting the WC of prescribed particle size for the contacts, the WC was screened with sieves, etc., and the alloyed contacts material was checked and screened by measurements on the alloy structure under the microscope before the contacts were submitted for evaluation.

WORKING EXAMPLES 16–18, COMPARATIVE EXAMPLE 9

The foregoing Working Examples 1–15 and Comparative Examples 1–8 show the benefit of the present invention when the mean particle size (the diameter when the particles are viewed as spherical) of the cobalt in the Ag—WC—Co or Ag—WC—Co—Fe alloy was set at 5 μm. However, the benefit of the present invention is not displayed exclusively at that mean particle size.

Thus, when a similar evaluation was made with the mean particle size of the WC set 0.7 μm and the mean particle size of the cobalt set at 0.1–10 μm, essentially the same good characteristics were exhibited in regard to current chopping characteristic, frequency of restrike and arc erosion resistance as in the Working Example 4 serving as standard. (Working Examples 16–18)

However, in a similar evaluation of 62% WC—Co-balance Ag wherein the mean particle size of the cobalt was set at 44 μm (Comparative Example 9), the arc erosion resistance showed a great deterioration, erosion increasing 15–25 fold compared with the Working Example 4 serving as standard. Furthermore, the maximum chopping current in the range 1–100 switching operations increased by a factor of 2.5 compared with the Working Example 4 serving as standard. Similarly, the maximum chopping current increased by a factor of 3 or more (the characteristic deteriorated) in 19,900–20,000 switching operations. A large increase in the incidence of restrike (a deterioration in characteristic) and a large dispersion therein were also seen.

Thus, comparing the incidence of restrike in Comparative Example 9 taking the incidence of restrike in 1000 and 20,000 current interruptions in the aforesaid Working Example 4 as the basis of comparison, the frequency in Comparative Example 9 increased greatly by a factor of 6–11 at 1000 and a factor of 15–17 at 20,000 (the characteristic deteriorated). The results of microscopic examination showed aggregation of WC and cobalt and the presence of Ag-depleted areas on the surface of the contacts. Hence, the art of the present invention to obtain a balance in restrike characteristic, current chopping characteristic and erosion resistance is displayed to effect when the mean particle size of the cobalt is not more than 10 μm as in Working Example 3 and Working Examples 16–18.

WORKING EXAMPLES 19–21, COMPARATIVE EXAMPLE 10

The foregoing Working Examples 1–18 and Comparative Examples 1–9 show the benefit of the present invention when the carbon in the alloy has a mean particle size (diameter when the particles are viewed as spheres) of 0.5 μm. However, the benefit of the present invention is not displayed exclusively at that mean particle size.

Thus, when a similar evaluation was made with the mean particle size of the carbon set 0.01–5 μm, essentially the same good characteristics were exhibited in regard to current chopping characteristic, frequency of restrike and arc erosion resistance as in the Working Example 4 serving as standard. (Working Examples 19–21)

However, in a similar evaluation of 62% WC—Co-balance Ag wherein the mean particle size of the carbon was set at 20 μm (Comparative Example 10), the arc erosion resistance showed a great deterioration, erosion increasing 20–44 fold compared with the Working Example 4 serving as standard. Furthermore, compared with the Working Example 4 serving as standard, the maximum chopping current in the range 1–100 switching operations increased by a factor of 2.6 while the maximum chopping current increased by a factor of 4.8 (the characteristic deteriorated) in 19,900–20,000 switching operations. A large increase in the incidence of restrike (a deterioration in characteristic) and a large dispersion therein were also seen.

Thus, comparing the incidence of restrike in Comparative Example 9 taking the incidence of restrike in 1000 and 20,000 current interruptions in the aforesaid Working Example 4 as the basis of comparison, the frequency in Comparative Example 9 increased by a factor of 2.7–4.5 at 1000 and a factor of 6–8 at 20,000 (the characteristic deteriorated). Microscopic examination showed that, in Comparative Example 10 where the mean particle size of the carbon was 20 μm, aggregation of carbon and C-depleted areas occurred on the surface of the contacts. Hence, the art of the present invention for obtaining a balance in the restrike characteristic, current chopping characteristic and erosion resistance is displayed to effect at the carbon mean particle size in Working Examples 19–21 of 0.01–5 μm or less.

WORKING EXAMPLES 22–24

The foregoing Working Examples 1–21 and Comparative Examples 1–10 show the benefit of the present invention when the amount of carbon in an undissolved state or non-compound-forming state present in the Ag—WC, Ag—WC—Co or Ag—WC—Co—Fe alloy is in the range 0.005–0.2%. However, the benefit of the present invention is not displayed exclusively thereby. The presence of carbon in the alloy afforded a similar benefit in respect of the same alloys containing bismuth, antimony or tellurium as an anti-weld component. (Working Examples 22–24)

Thus, when a similar evaluation to the above was made, essentially the same good characteristics were exhibited in regard to current chopping characteristic, frequency of restrike and arc erosion resistance.

The said anti-weld components have little effect in improving the welding resistance of Ag—WC, Ag—WC—Co and Ag—WC—Co—Fe alloys at a content of less than 0.05% and adversely affect the restrike characteristic at more than 0.5%. Accordingly, a balance between the restrike characteristic, current chopping characteristic, arc erosion resistance and welding resistance is obtained when the amount of anti-weld component in the Ag—WC, Ag—WC—Co or Ag—WC—Co—Fe alloy is in the range 0.05–0.5%.

When the degree of dispersion of the carbon particles (the distance between carbon particles in closest mutual proximity) in the Ag—WC—Co alloys in the foregoing Working Examples 19–21 and Comparative Example 10 was examined to make a more detailed analysis of the distribution of carbon particles in an undissolved state or non-compound-forming state, the distance L between the carbon particles in closest mutual proximity in the alloys of Working Examples 19–21 was equal to or greater than the diameter d of the smaller of the carbon particles ($L \geqq d$). Thus, the carbon was in a satisfactory state of dispersion.

In contrast, the diameter d of the carbon particles was found to be greater than the distance L between the particles ($L<d$) in the alloy of Comparative Example 10. Thus, local aggregation of the carbon particles was seen and the state of dispersion was unsatisfactory.

A similar evaluation to the above was therefore made selecting contacts from the material of Comparative Example 10 wherein $L<d$ and the carbon particle size was 0.5 μm. (Comparative Example 11)

In particular, comparing the incidence of restrike in Comparative Example 11 taking the incidence of restrike in 1000 current interruptions in the aforesaid Working Example 4 as the basis of comparison, there was an increase of no more than about 2-fold in the incidence in 1000 interruptions (the characteristic deteriorated) whereas in 20,000 interruptions the incidence increased by a factor of 2.6–13 and a large dispersion in incidence was seen.

In a similar evaluation of current chopping characteristic in comparison with the Working Example 4 serving as standard, the chopping current increased by a factor of 1.2–1.45 in the range 1–100 switching operations whereas the chopping current in 19,900–20,000 switching operations increased by a factor of more than 3 (the characteristic deteriorated).

WORKING EXAMPLES 25–26, COMPARATIVE EXAMPLE 12

The foregoing Working Examples 1–24 and Comparative Examples 1–11 showed the benefit of the present invention when the thickness of the alloy layer on the test contacts was held constant at 3 mm. However, the benefit of the present invention is not displayed exclusively thereby. Thus, desirable characteristics are displayed at a contact thickness of 0.3 mm (Working Example 25), and likewise at the greater thickness of 6 mm (Working Example 26).

However, when the thickness of the alloy layer was 0.1 mm (Comparative Example 12), exposure of the pure silver layer providing the substrate and cracking and rupture of the alloy layer were noted in parts of the surface of the contacts after evaluation of current chopping. Because of this, evaluation of the restrike characteristic and arc erosion resistance was aborted. Accordingly, it is advisable to set the alloy layer thickness at not less than 0.3 mm. It is possible to improve the electrical conductivity as contacts material by ensuring the silver content increases in the direction of the interior of the Ag—WC contacts (the perpendicular direction), or by providing a copper layer at the bottom of the alloy layer, for example.

WORKING EXAMPLES 27–29, COMPARATIVE EXAMPLE 13

The foregoing Working Examples 1–26 and Comparative Examples 1–12 showed the benefit of the present invention when the average finished roughness of the surface of the contacts was held constant at 0.3 μm. However, the benefit of the present invention is not displayed exclusively thereby. Thus, desirable characteristics were also displayed when the average finished roughness of the contact surface was set at 0.05 μm, 1 μm and 10 μm. (Working Examples 27–29)

Conversely, if the surface finish of the surface of contact is made extremely smooth, silver may be selectively removed during processing, depending on the conditions in the finishing process, and as only WC then remains at the surface, this is apt to give a surface of contact with little silver phase present. As a result, problems arise with the contact resistance and temperature rise characteristics.

On the other hand, when the average finished roughness of the surface of contact is set at 25 μm (Comparative Example 13), the frequency of restrike greatly increases and a large dispersion arises therein. Thus, comparing the incidence of restrike in Comparative Example 13 taking the incidence of restrike in 1000 and 20,000 current interruptions in the aforesaid Working Example 4 as the basis of comparison, the frequency in Comparative Example 13 increased by a factor of 4–20 in 1000 interruptions and a factor of 3.5–27.5 in 20,000 interruptions (the characteristic deteriorated). Erosion likewise increased by a factor of 4.4–19.6. Accordingly, it is desirable to set the average finished roughness of the surface of contact at 0.05–10 vm. Additional finishing of the surface by breaking a current of 1–10 mA with a voltage of 10 kV applied to the surface of contact finished to the aforesaid average roughness of 0.05–10 μm contributed to further stabilization of the restrike characteristic.

As will be clear from the results of the aforesaid working examples, the vacuum circuit breaker contacts material claimed for the present invention affords improved stability of characteristics by virtue of the fact that the amount of carbon and the state thereof in the Ag—WC alloy are optimized and Co, Fe, Bi, Sb and/or Te are alloyed therewith as ancillary components.

Thus, optimization of the amount and state of dispersion of carbon in an undissolved state or non-compound-forming state was sought. Consequently, as well as controlling the response when the contact receives an arc so that the amount of silver selectively and preferentially evaporated and dispersed is small, the present invention inhibits marked cracking on the surface of the contacts due to thermal shock under arcing, an effect detrimental to suppression of restrike, and reduces dispersal and shedding of tungsten carbide particles.

Since the uniformity of alloy structure is thus improved, fusion and dispersal damage to the surface of the contacts after an arc is taken decreases; this reduces the extent of roughening of the surface of the contacts, which has an important effect on restrike suppression, and is beneficial in improving the arc erosion resistance, enabling the provision of vacuum circuit breaker contacts material with outstanding characteristics.

The present invention enables the reliability of contacts materials to be improved.

Obviously, numerous additional modifications and variations of the present invention are possible in the light of the above teachings. It is therefore to be understood that within the scope of the appended claims, the present invention may be practiced otherwise than as specially described herein.

We claim:

1. A contacts material, comprising:

a silver-tungsten carbide alloy containing 55 weight % to 70 weight % of tungsten carbide of a mean particle size of 0.1 μm to 6 μm, wherein 0.005 weight % to 0.2 weight % of carbon particles of equivalent diameter from 0.01 to 5 μm are present in an undissolved state or non-compound-forming state;

said carbon being highly dispersed and distributed through said silver-tungsten carbide alloy and the carbon particles being separated by an average distance not less than the size of adjacent carbon particles; and the average roughness (Rave) of a contact surface of said contacts material being within the range of 0.05 μm to 10 μm.

2. The contacts material according to claim 1, wherein: the amount of said silver is increased from the surface of contact of said contacts material towards the interior (the direction perpendicular to said surface).

3. The contacts material according to claim 1, wherein:

a copper layer is provided on a surface of said contacts material.

4. The contacts material according to claim 1, wherein:

the alloy is in the form of a layer and the thickness of the layer is not less than 0.3 mm.

5. The contacts material according to claim 1, wherein:

said material has been surface-finished by current breaking at a current of 1–10 mA with a voltage of not less than 10 kV applied to a contact surface of said contacts material.

6. A contacts material comprising:

a silver-tungsten carbide-cobalt alloy containing not more than 5 weight % of cobalt and 55 weight % to 70 weight % of tungsten carbide of a mean particle size of 0.1 μm to 6 μm, wherein 0.005 weight % to 0.2 weight % of carbon particles of equivalent diameter from 0.01 μm to 5 μm are present in an undissolved state or non-compound-forming state;

said carbon being highly dispersed and distributed through said silver-tungsten carbide alloy and the carbon particles being separated by an average distance not less than the size of adjacent carbon particles; and the average roughness (Rave) of a contact surface of said contacts material is in the range of 0.5 μm to 10 μm.

7. The contacts material according to claim 6, wherein:

the amount of said silver is increased from the surface of contact of said contacts material towards the interior (the direction perpendicular to said surface).

8. The contacts material according to claim 6, wherein: a copper layer is provided on a surface of said contacts material.

9. The contacts material according to claim 2, wherein: the alloy is in the form of a layer and the thickness of the layer is not less than 0.3 mm.

10. The contacts material according to claim 6, wherein: said material has been surface-finished by current breaking at a current of 1–10 mA with a voltage of not less than 10 kV applied to said surface of contact of said contacts material.

11. A contacts material according to claim 1 or 6, wherein: said silver-tungsten carbide alloy or silver-tungsten carbide-cobalt alloy contains between 0.01 weight % and 0.55 weight % of iron.

12. A contacts material according to claim 1 or 6, wherein: said silver-tungsten carbide alloy or silver-tungsten carbide-cobalt alloy contains between 0.05 weight % and 0.5 weight % of at least one of bismuth, antimony or tellurium.

* * * * *